US009624935B2

(12) United States Patent
Sun

(10) Patent No.: US 9,624,935 B2
(45) Date of Patent: Apr. 18, 2017

(54) COOLING FAN WITH ROTOR SHAFT END ABUTTING POLYOXYMETHYLENE TUBE BOTTOM

(71) Applicants: FURUI PRECISE COMPONENT (KUNSHAN) CO., LTD., Kunshan (CN); Foxconn Technology Co., Ltd., New Taipei (TW)

(72) Inventor: Qiao-Yun Sun, Kunshan (CN)

(73) Assignees: FURUI PRECISE COMPONENT (KUNSHAN) CO., LTD., Kunshan (CN); Foxconn Technology Co., Ltd., New Taipei (TW)

( * ) Notice: Subject to any disclaimer, the term of this patent is extended or adjusted under 35 U.S.C. 154(b) by 872 days.

(21) Appl. No.: 13/714,324

(22) Filed: Dec. 13, 2012

(65) Prior Publication Data

US 2014/0147281 A1 May 29, 2014

(30) Foreign Application Priority Data

Nov. 23, 2012 (CN) ..... 2012 1 04814391

(51) Int. Cl.

| | |
|---|---|
| ***F04D 29/06*** | (2006.01) |
| ***F04D 25/06*** | (2006.01) |
| ***F04D 29/02*** | (2006.01) |

(52) U.S. Cl.

CPC ..... *F04D 25/062* (2013.01); *F04D 29/023* (2013.01); *F05D 2300/43* (2013.01)

(58) Field of Classification Search

CPC ..... F04D 25/062; F04D 29/023; F04D 29/056
USPC ..... 416/174; 415/229, 175, 176
See application file for complete search history.

(56) References Cited

U.S. PATENT DOCUMENTS

| | | | | |
|---|---|---|---|---|
| 6,320,291 | B1 * | 11/2001 | Lin | F04D 29/646 310/67 R |
| 6,398,526 | B1 * | 6/2002 | Yang | F04D 29/056 417/423.7 |
| 6,517,318 | B2 * | 2/2003 | Hsieh | F04D 29/051 415/119 |
| 7,922,446 | B2 * | 4/2011 | Bei | F04D 29/626 415/229 |
| 8,033,796 | B2 * | 10/2011 | Kameya | F04C 2/102 361/698 |

(Continued)

FOREIGN PATENT DOCUMENTS

| | | |
|---|---|---|
| CN | 101285476 A | 10/2008 |
| CN | 101311548 A | 11/2008 |

(Continued)

*Primary Examiner* — Ninh H Nguyen
*Assistant Examiner* — Aaron R Eastman
(74) *Attorney, Agent, or Firm* — Zhigang Ma

(57) ABSTRACT

An exemplary cooling fan includes a base, a central tube formed at the base, a stator, and a rotor being rotatable relative to the stator. The central tube is made of polyoxymethylene. The central tube includes a bottom plate mounted on the base and a peripheral sidewall extending upwardly from a peripheral edges of the bottom plate. The bottom plate and the sidewall cooperatively define a blind hole therebetween. The stator is mounted around the sidewall of the central tube. The rotor includes a hub and a shaft extending from the hub. The shaft includes a free end received in the blind hole and directly abutting the bottom plate.

19 Claims, 2 Drawing Sheets

(56) References Cited

U.S. PATENT DOCUMENTS 8,066,487 B2 * 11/2011 Luo ..... F04D 25/0613 403/243
2004/0141840 A1 7/2004 Lin
2007/0267928 A1 * 11/2007 Yeh ..... H02K 7/085 310/90
2008/0253888 A1 10/2008 Hsiao et al.
2008/0292479 A1 * 11/2008 Lin ..... F04D 29/056 417/423.7
2008/0298983 A1 * 12/2008 Tsai ..... F04D 29/056 417/354
2009/0120721 A1 * 5/2009 Li ..... F04D 29/063 184/6.27
2009/0290975 A1 * 11/2009 Li ..... F04D 29/063 415/111
2010/0329886 A1 12/2010 Sung et al.
2011/0033300 A1 * 2/2011 Li ..... F04D 25/0626 416/174
2011/0091314 A1 * 4/2011 Li ..... F04D 29/056 415/180
2011/0135464 A1 * 6/2011 Luo ..... F04D 29/057 415/230

FOREIGN PATENT DOCUMENTS

CN 101751094 A 6/2010
CN 201953723 U 8/2011
TW 578860 U 3/2004
TW M300726 U 11/2006
TW 200847911 A 12/2008
TW M371180 12/2009

* cited by examiner

COOLING FAN WITH ROTOR SHAFT END ABUTTING POLYOXYMETHYLENE TUBE BOTTOM

BACKGROUND

1. Technical Field

The disclosure generally relates to cooling fans such as those used in electronic devices, and particularly to a cooling fan having a tube and a rotor configured for stable performance of the cooling fan.

2. Description of Related Art

With the continuing development of electronics technology, heat-generating electronic components such as CPUs (central processing units) are generating more and more heat when in operation. In typical devices that employ CPUs, the heat requires immediate dissipation. Cooling fans are commonly used in combination with heat sinks for cooling the CPUs.

A typical cooling fan includes a fan housing, a stator, and a rotor. The fan housing forms a base at a central portion thereof, the stator is mounted on the base, and the rotor is rotatably supported by the stator. In detail, the stator is mounted around a central tube formed at a central portion of the base. A receiving hole is defined in the central tube. The rotor includes a hub and a shaft extending from the hub. A wear plate is received in a bottom end of the receiving hole. An end of the shaft is received in the receiving hole of the central tube and abuts the wear plate. A clasp is received in the receiving hole. The clasp clasps the shaft and abuts against inner surfaces of the receiving hole to fix the shaft in the central tube. A thickness of the wear plate is less than 0.3 mm (millimeters), and the wear plate is light in weight. When the cooling fan is working, the wear plate is liable to be displaced by circulating oil and may become offset. The offset wear plate causes the shaft and the clasp to become offset. The offset clasp may interfere with the shaft, jamming the shaft such that the shaft can no longer rotate properly relative to the stator. Thus, the cooling fan is liable to malfunction or even fail altogether.

What is needed, therefore, is an improved cooling fan which can overcome the above-described shortcomings

DETAILED DESCRIPTION

An embodiment of a cooling fan in accordance with the present disclosure will now be described in detail below and with reference to the drawings.

Figure 1:
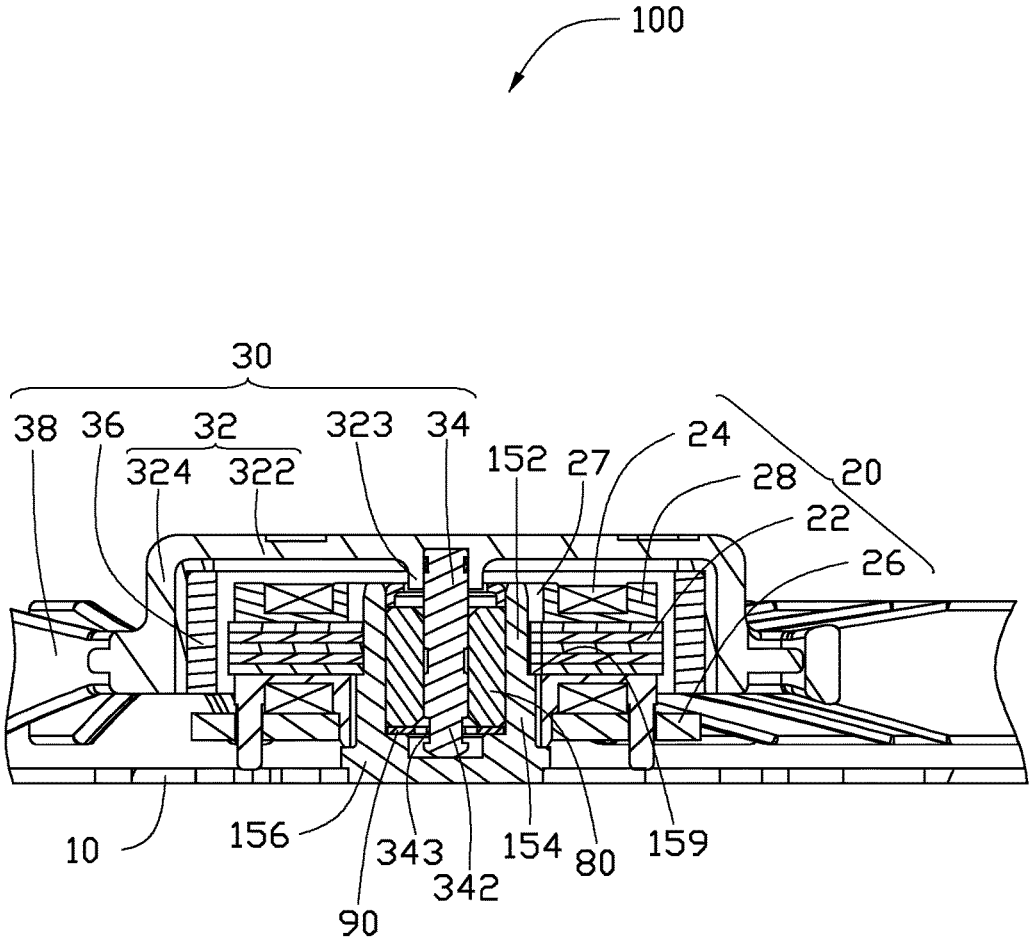
FIG. 1 is a schematic, cross-sectional view of a central part of a cooling fan in accordance with an exemplary embodiment.

FIG. 1 shows a cooling fan 100 in accordance with an exemplary embodiment of the disclosure. The cooling fan 100 includes a base plate 10, a stator 20 mounted on the base plate 10, and a rotor 30 engaging with the stator 20.

The rotor 30 includes a cylindrical hub 32, a shaft 34, a magnet 36 and a plurality of blades 38. The hub 32 includes a top wall 322, and a sidewall 324 extending downwardly from a circumferential edge of the top wall 322. A shaft seat 323 is formed in a central portion of the top wall 322. The shaft 34 extends downwardly from within the seat 323 to below the shaft seat 323. The shaft 34 has a bottom free end 342. An edge of the free end 342 is chamfered. An annular recess 343 is defined in the shaft 34 at the free end 342. The blades 38 extend obliquely outwardly from an outer periphery of the sidewall 324 of the hub 32. The blades 38 are spaced from each other. The magnet 36 is annular and received in the hub 32. An outer periphery of the magnet 36 contacts an inner surface of the sidewall 324.

The stator 20 includes a printed circuit board (PCB) 26, a stator core 22, an insulating frame 28, and a plurality of stator coils 24. The insulating frame 28 encloses the stator core 22 therein. The stator coils 24 are wound on the insulating frame 28 and around the stator core 22. Thus, the stator coils 24 are electrically separated from the stator core 22 by the insulating frame 28. The PCB 26 is attached to a bottom side of the insulating frame 28, and is electrically connected with the stator coils 24 to control an electrical current flowing through the stator coils 24. A through hole is defined in each of the stator core 22, the insulating frame 28, and the PCB 26. The through holes of the stator core 22, the insulating frame 28, and the PCB 26 are coaxial, and cooperatively define a mounting hole 27. The mounting hole 27 is centered along an axial direction of the stator 20.

Figure 2:
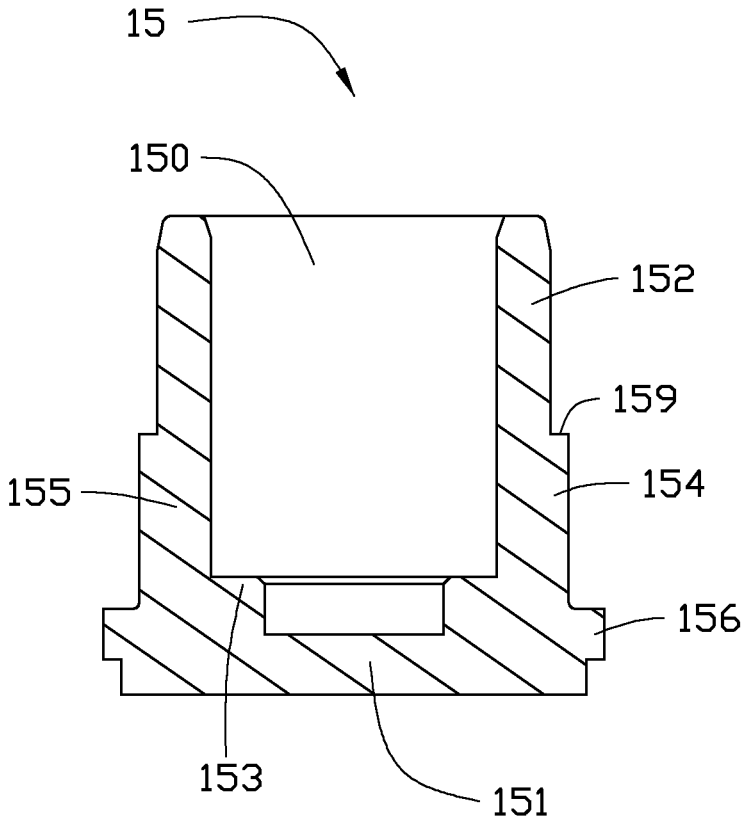
FIG. 2 is an enlarged view of a central tube of a fan housing of the cooling fan of FIG. 1, showing the central tube in isolation.

Referring also to FIG. 2, the base plate 10 is elongated, and a central tube 15 extends upwardly from a central portion of the base plate 10. The central tube 15 is made of polyoxymethylene.

The central tube 15 is column-shaped, and includes a bottom plate 151 and a cylindrical sidewall 155 extending upwardly from a peripheral edge of the bottom plate 151. The bottom plate 151 and the sidewall 155 cooperatively define a blind hole 150 therebetween, with the blind hole 150 centered along an axial direction of the central tube 15. The central tube 15 includes a main section 154, a fixing section 152 formed at a top end of the main section 154, and a securing section 156 formed at a bottom end of the main section 154. The fixing section 152 has an outer diameter smaller than that of the main section 154, whereby an annular outer step 159 is formed between the fixing section 152 and the main section 154. The outer diameter of the main section 154 is smaller than that of the securing section 156.

An annular inner step 153 extends inwardly from an inner circumferential surface of a bottommost portion of the sidewall 155 of the central tube 15. A bearing 80 is received in the blind hole 150 of the central tube 15. An annular clasp 90 is received in the blind hole 150, and located between the bearing 80 and the inner step 153. The clasp 90 is also received in the recess 343 of the free end 342 of the shaft 34. Thus, the clasp 90 clasps the shaft 34 and abuts against the inner circumferential surface of the sidewall 155 of the central tube 15 to fix the shaft 34 in the central tube 15.

Referring to FIG. 1 again, in assembly of the cooling fan 100, the stator 20 is pressed downwardly around the central tube 15. During such pressing, the fixing section 152 of the central tube 15 extends sequentially through the PCB 26, the insulating frame 28, and the stator core 22 and is received in the mounting hole 27. A bottom of the stator core 22 abuts on the outer step 159 of the central tube 15. The clasp 90 is pressed into the blind hole 150 and located at a top end of the inner step 153. Then the bearing 80 is received in the blind hole 150 and abuts the clasp 90. Next, the free end 342 of the shaft 34 is extended sequentially through the bearing 80 and the clasp 90, and snappingly engages with the clasp 90. A bottom extremity of the free end 342 directly abuts the bottom plate 151 of the central tube 15.

It is to be understood, however, that even though numerous characteristics and advantages of the embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cooling fan, comprising:

a base;

a central tube made of polyoxymethylene, the central tube having a bottom plate mounted on the base and a peripheral sidewall extending upward from a peripheral edge of the bottom plate;

a blind hole, wherein the blind hole is defined by and located between the bottom plate and the sidewall;

a stator mounted around peripheral of the sidewall of the central tube;

a rotor, the rotor being rotatable relative to the stator, the rotor comprising a hub and a shaft extending from the hub, the shaft having a free end received in the blind hole and directly abutting the bottom plate, wherein a bottom extremity of the free end directly abuts and contacts the bottom plate of the central tube; and an annular clasp received in the blind hole, the annular clasp comprising an inner edge, wherein the inner edge of the clasp engages with an outer circumferential surface of the free end.

2. The cooling fan of claim 1, wherein the annular clasp comprises an outer edge, the outer edge of the annular clasp abuts against an inner circumferential surface of the sidewall.

3. The cooling fan of claim 2, wherein an annular recess is defined in the shaft at the free end, and the inner edge of the annular clasp is received in the recess and engaged with the shaft.

4. The cooling fan of claim 2, wherein an annular inner step extends inwardly from the inner circumferential surface of a bottom portion of the sidewall, and the annular clasp abuts a top end of the inner step.

5. The cooling fan of claim 2, wherein a bearing is received in the blind hole and located at a top of the annular clasp.

6. The cooling fan of claim 2, wherein the central tube includes a main section and a fixing section formed at a top end of the main portion, and the fixing section has an outer diameter smaller than the main section, whereby an annular outer step is formed between the fixing section and the main section, and the stator is mounted around the fixing section and abuts the step.

7. The cooling fan of claim 6, wherein the central tube further comprises a securing section formed at a bottom end of the main section, and the securing section is formed on the base.

8. The cooling fan of claim 1, wherein an edge of the free end is chamfered.

9. The cooling fan of claim 1, wherein the rotor further comprises a plurality of blades extending radially and outwardly from an outer periphery of the hub.

10. A cooling fan, comprising:

a central tube made of polyoxymethylene, the central tube having a bottom plate and a cylindrical sidewall extending upward from a circumferential edge of the bottom plate;

a blind hole, wherein the blind hole is defined by and located between the bottom plate and the sidewall;

a stator mounted around peripheral of the sidewall of the central tube;

a rotor, the rotor being rotatable relative to the stator, the rotor comprising a hub and a shaft extending from the hub, the shaft having a free end received in the blind hole and directly abutting the bottom plate, wherein a bottom extremity of the free end directly abuts and contacts the bottom plate of the central tube; and an annular clasp received in the blind hole, the annular clasp comprising an inner edge, wherein the inner edge of the clasp engages with an outer circumferential surface of the free end, and an outer edge of the clasp abuts against an inner circumferential surface of the sidewall.

11. The cooling fan of claim 10, wherein an annular recess is defined in the shaft at the free end, and the inner edge of the annular clasp is received in the recess and engaging with the shaft.

12. The cooling fan of claim 10, wherein an inner annular step extends inwardly from the inner circumferential surface of a bottom portion of the sidewall, and the annular clasp abuts a top end of the step.

13. The cooling fan of claim 10, wherein the rotor comprises a plurality of blades extending obliquely outwardly from an outer periphery of the hub.

14. A cooling fan, comprising:

a base;

a central tube made of polyoxymethylene, the central tube having a bottom plate mounted on the base and a peripheral sidewall extending upward from a peripheral edge of the bottom plate;

a blind hole, wherein the blind hole is defined by and located between the bottom plate and the sidewall;

a stator mounted around peripheral of the sidewall of the central tube;

a rotor, the rotor being rotatable relative to the stator, the rotor comprising a hub and a shaft extending from the hub, the shaft having a free end received in the blind hole and directly abuts the bottom plate; and an annular clasp received in the blind hole, the annular clasp comprising an inner edge, wherein the inner edge of the clasp engages with an outer circumferential surface of the free end.

15. The cooling fan of claim 14, wherein the annular clasp comprises an outer edge, the outer edge of the annular clasp abuts against an inner circumferential surface of the sidewall.

16. The cooling fan of claim 15, wherein an annular recess is defined in the shaft at the free end, and the inner edge of the annular clasp is received in the recess and engaged with the shaft.

17. The cooling fan of claim 15, wherein an annular inner step extends inwardly from the inner circumferential surface of a bottom portion of the sidewall, and the annular clasp abuts a top end of the inner step.

18. The cooling fan of claim 15, wherein a bearing is received in the blind hole and located at a top of the annular clasp.

19. The cooling fan of claim 15, wherein the central tube includes a main section and a fixing section formed at a top end of the main portion, and the fixing section has an outer diameter smaller than the main section, whereby an annular outer step is formed between the fixing section and the main section, and the stator is mounted around the fixing section and abuts the step.

* * * * *